US011721300B2

(12) United States Patent
Kwon et al.

(10) Patent No.: US 11,721,300 B2
(45) Date of Patent: Aug. 8, 2023

(54) DISPLAY APPARATUS IN WHICH GATE PULSES ARE OUTPUTTED SEQUENTIALLY TO ALTERNATE SIDES OF A GATE LINE

(71) Applicant: LG Display Co., Ltd., Seoul (KR)

(72) Inventors: OhJong Kwon, Paju-si (KR); Geunyoung Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/561,288

(22) Filed: Dec. 23, 2021

(65) Prior Publication Data

US 2022/0208138 A1 Jun. 30, 2022

(30) Foreign Application Priority Data

Dec. 31, 2020 (KR) ..... 10-2020-0189795

(51) Int. Cl.
*G09G 3/36* (2006.01)

(52) U.S. Cl.
CPC ..... *G09G 3/3677* (2013.01); *G09G 3/3688* (2013.01); *G09G 2300/0857* (2013.01); *G09G 2310/0278* (2013.01); *G09G 2310/0286* (2013.01); *G09G 2310/0289* (2013.01)

(58) Field of Classification Search
CPC ..... G09G 3/36; G09G 3/3611; G09G 3/3614; G09G 3/3622; G09G 3/3625; G09G 3/3674; G09G 3/3677; G09G 3/3681; G09G 3/3685; G09G 3/3688; G09G 3/3692; G09G 2310/0278; G09G 2310/0286
USPC ..... 345/87–104
See application file for complete search history.

(56) References Cited

U.S. PATENT DOCUMENTS

2007/0018928 A1* 1/2007 Ludden ..... G09G 3/3614 345/96
2008/0129652 A1 6/2008 Park
2009/0278782 A1* 11/2009 Chen ..... G09G 3/3677 345/100
2011/0012932 A1* 1/2011 Morimoto ..... G09G 3/20 345/690

(Continued)

FOREIGN PATENT DOCUMENTS

CN 101364391 A 2/2009
CN 101487962 A 7/2009

(Continued)

*Primary Examiner* — Amit Chatly
*Assistant Examiner* — Nelson Lam
(74) *Attorney, Agent, or Firm* — Seed IP Law Group LLP

(57) ABSTRACT

A display apparatus sequentially outputs gate pulses to one side and the other side of gate lines. The display apparatus includes a display panel provided with four non-display areas outside a display area, a gate driver provided in a first non-display area of the non-display areas, a data driver provided in the first non-display area, and a controller for controlling the gate driver and the data driver. Gate lines connected to connection lines extended from the gate driver are provided in a second direction different from a first direction in which the connection lines are provided. Gate pulses supplied from the gate driver to the gate lines through the connection lines are alternately output from a first side and a second side of the gate lines. The first side and the second side are divided from each other based on a center portion of the gate lines as a boundary.

19 Claims, 8 Drawing Sheets

(56) References Cited

U.S. PATENT DOCUMENTS

| | | | | |
|---|---|---|---|---|
| 2013/0187843 | A1* | 7/2013 | Iwamoto | G09G 3/3611 345/100 |
| 2014/0043306 | A1* | 2/2014 | Min | G09G 3/3677 345/204 |
| 2015/0115292 | A1 | 4/2015 | Jeon et al. | |
| 2015/0339989 | A1* | 11/2015 | Hasegawa | G09G 3/20 345/694 |
| 2015/0379955 | A1* | 12/2015 | Jeon | G09G 3/3677 345/212 |
| 2016/0189650 | A1* | 6/2016 | Lee | H01L 27/1259 345/87 |
| 2018/0025691 | A1* | 1/2018 | Ota | G09G 3/3413 345/96 |
| 2020/0211493 | A1 | 7/2020 | Kim et al. | |
| 2021/0142754 | A1* | 5/2021 | Hayashi | G02F 1/136227 |

FOREIGN PATENT DOCUMENTS

| | | | |
|---|---|---|---|
| CN | 102414735 | A | 4/2012 |
| CN | 105741732 | A | 7/2016 |
| EP | 1492078 | A2 | 12/2004 |
| EP | 3561801 | A1 | 10/2019 |
| GB | 2589417 | A | 6/2021 |
| JP | 2010072363 | A | 4/2010 |

* cited by examiner

DISPLAY APPARATUS IN WHICH GATE PULSES ARE OUTPUTTED SEQUENTIALLY TO ALTERNATE SIDES OF A GATE LINE

CROSS-REFERENCE TO RELATED APPLICATIONS

This application claims the benefit of the Korean Patent Application No. 10-2020-0189795 filed on Dec. 31, 2020, which are hereby incorporated by reference as if fully set forth herein.

BACKGROUND

Technical Field

The present disclosure relates to a display apparatus.

Description of the Related Art

A liquid crystal display apparatus and a light emitting display apparatus may be included in display apparatuses. The display apparatus includes a display panel.

Gate pulses are sequentially output to gate lines provided in the display panel.

Particularly, the gate pulses are sequentially output from one sides of the gate lines.

In this case, a luminance difference may occur in one side and the other side of the gate lines.

BRIEF SUMMARY

The present disclosure has been made in view of the above problems and it is a technical feature of the present disclosure to provide a display apparatus that may sequentially output gate pulses to one side and the other side of gate lines.

In addition to the technical features of the present disclosure as mentioned above, additional technical features and advantages of the present disclosure will be clearly understood by those skilled in the art from the following description of the present disclosure.

In accordance with an embodiment of the present disclosure, the above and other features can be accomplished by the provision of a display apparatus comprising a display panel provided with four non-display areas outside a display area, a gate driver provided in a first non-display area of the non-display areas, a data driver provided in the first non-display area, and a controller for controlling the gate driver and the data driver, wherein gate lines connected to connection lines extended from the gate driver are provided in a second direction different from a first direction in which the connection lines are provided, gate pulses supplied from the gate driver to the gate lines through the connection lines are alternately output from a first side and a second side of the gate lines, and the first side and the second side are divided from each other based on a center portion of the gate lines as a boundary.

In accordance with various embodiments, a display apparatus includes a display plane, a gate driver, gate lines and connection lines. The display panel has a display area and a non-display area. The non-display area is outside the display area. The gate driver is provided in the non-display area. The gate lines include odd gate lines extending in a second direction, and even gate lines extending in the second direction. The connection lines include first side connection lines extending in a first direction different from the second direction. The first side connection lines are positioned on a first side of the gate lines. The connection lines further include second side connection lines extending in the first direction. The second side connection lines are positioned on a second side of the gate lines. The second side and the first side are on opposite sides of a center portion of the gate lines. Gate pulses supplied from the gate driver to the gate lines through the connection lines are alternately output from the first side and the second side of the gate lines.

In accordance with various embodiments, a method includes: outputting gate pulses by a gate driver of a display apparatus, the gate pulses being outputted over connection lines extending in a first direction; and receiving the gate pulses by gate lines connected to the connection lines, the gate lines extending in a second direction different from the first direction. The outputting includes supplying the gate pulses from the gate driver to the gate lines through the connection lines alternately from a first side and a second side of the gate lines. The first side and the second side are divided from each other based on a center portion of the gate lines as a boundary.

BRIEF DESCRIPTION OF THE SEVERAL VIEWS OF THE DRAWINGS

The above and other objects, features and other advantages of the present disclosure will be more clearly understood from the following detailed description taken in conjunction with the accompanying drawings, in which.

DETAILED DESCRIPTION

Figure 1:
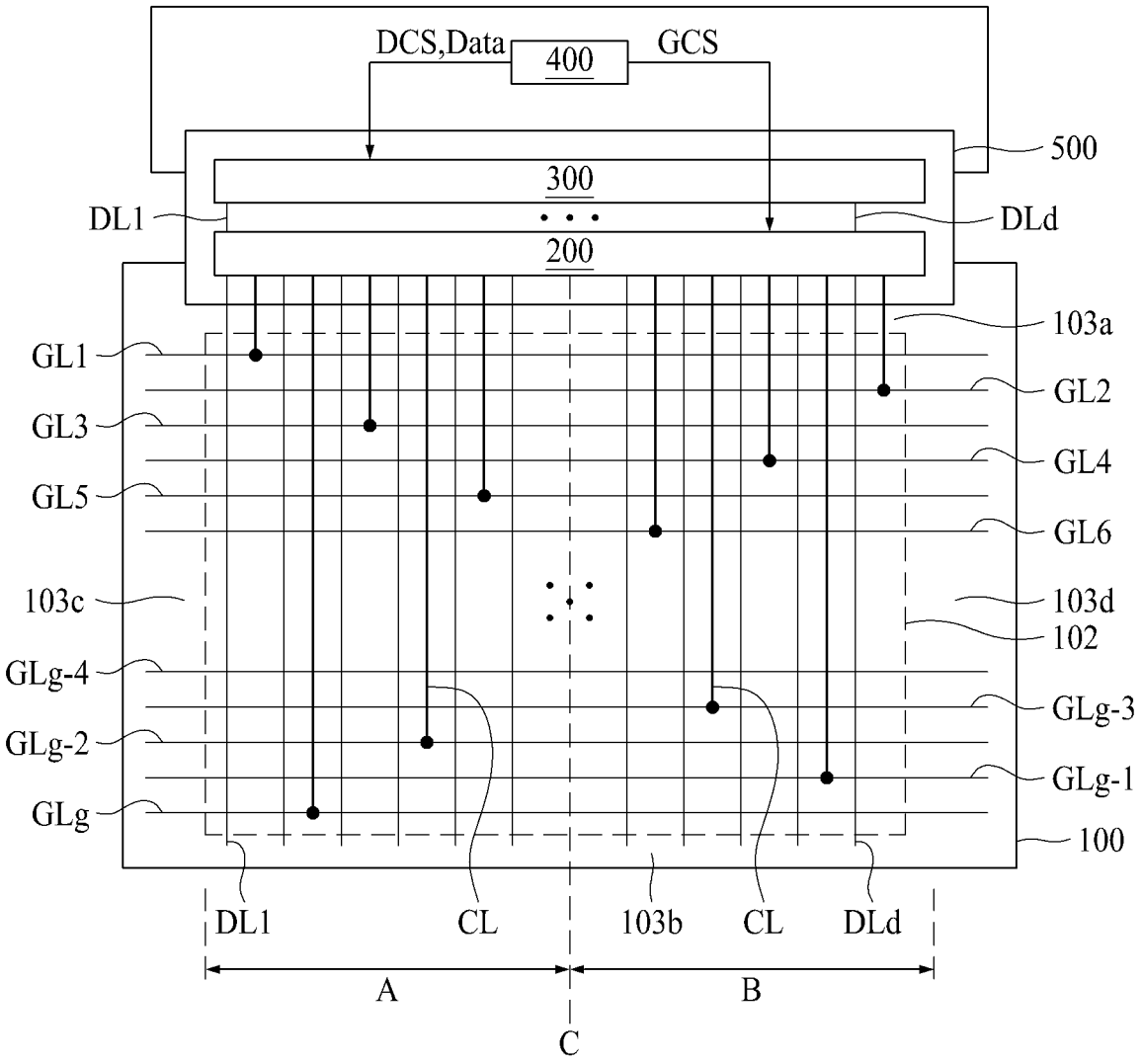
FIG. 1 is a view illustrating a structure of a light emitting display apparatus according to the present disclosure.

Advantages and features of the present disclosure and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete and will fully convey the scope of the present disclosure to those skilled in the art.

In the drawings, the same or similar elements are denoted by the same reference numerals even though they are depicted in different drawings. Wherever possible, the same reference numbers will be used throughout the drawings to refer to the same or like parts.

A shape, a size, a ratio, an angle and a number disclosed in the drawings for describing embodiments of the present disclosure are merely an example and thus, the present disclosure is not limited to the illustrated details. Like reference numerals refer to like elements throughout the specification. In the following description, when the detailed description of the relevant known function or configuration is determined to unnecessarily obscure the technical features of the present disclosure, the detailed description will be omitted. In a case where 'comprise', 'have' and 'include' described in the present disclosure are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~' and 'next to~', one or more portions may be arranged between two other portions unless 'just' or 'direct' is used.

In describing a temporal relationship, for example, when the temporal order is described as 'after~', 'subsequent~', 'next~' and 'before~', a case which is not continuous may be included unless 'just' or 'direct' is used.

It should be understood that the term "at least one" includes all combinations related with any one item. For example, "at least one among a first element, a second element and a third element" may include all combinations of two or more elements selected from the first, second and third elements as well as each element of the first, second and third elements.

It will be understood that, although the terms "first," "second," etc., may be used herein to describe various elements, these elements should not be limited by these terms. These terms are only used to distinguish one element from another. For example, a first element could be termed a second element and, similarly, a second element could be termed a first element, without departing from the scope of the present disclosure.

Features of various embodiments of the present disclosure may be partially or overall coupled to or combined with each other and may be variously inter-operated with each other and driven technically as those skilled in the art can sufficiently understand. The embodiments of the present disclosure may be carried out independently from each other or may be carried out together in co-dependent relationship.

Hereinafter, the embodiment of the present disclosure will be described in detail with reference to the accompanying drawings.

Figure 2A:
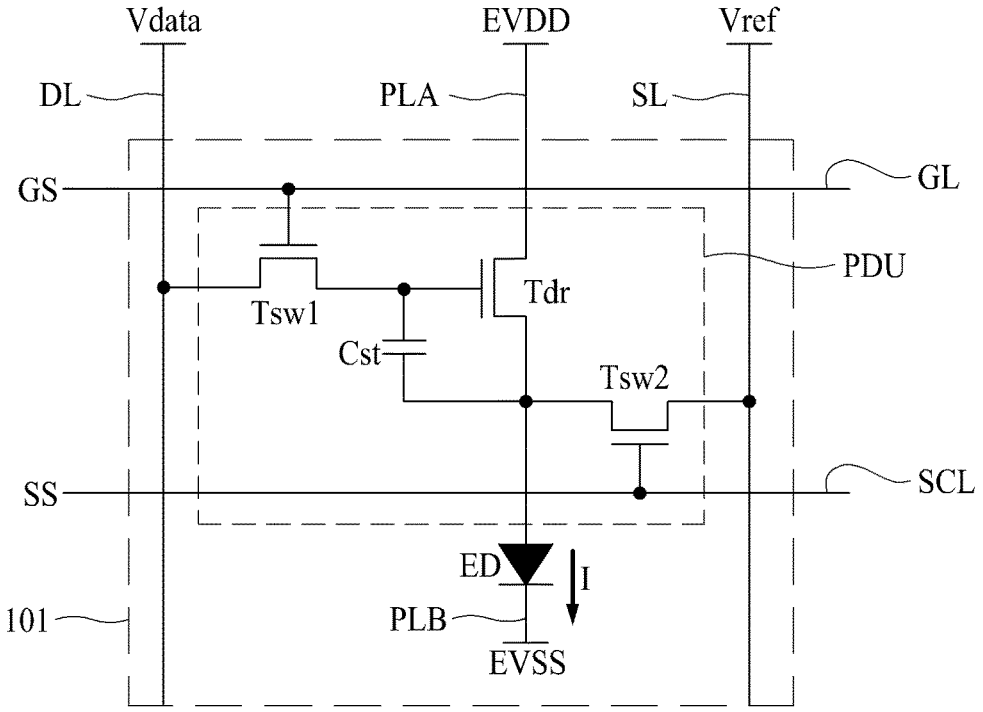
FIGS. 2A and 2B are views illustrating a structure of pixels applied to a light emitting display apparatus according to the present disclosure.
Figure 2B:
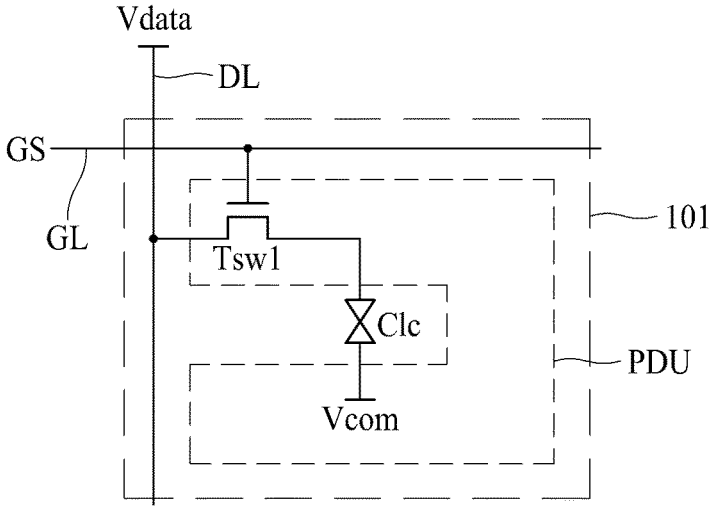
Figure 3:
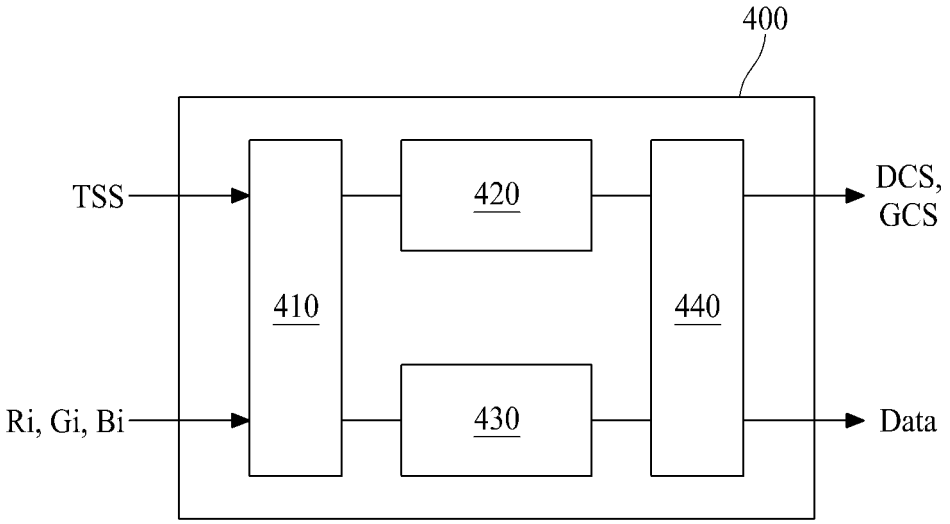
FIG. 3 is a view illustrating a structure of a controller applied to a light emitting display apparatus according to the present disclosure.

FIG. 1 is a view illustrating a structure of a light emitting display apparatus according to the present disclosure, FIGS. 2A and 2B are views illustrating a structure of pixels applied to a light emitting display apparatus according to the present disclosure, and FIG. 3 is a view illustrating a structure of a controller applied to a light emitting display apparatus according to the present disclosure.

The light emitting display apparatus according to the present disclosure may be included in various electronic devices. The electronic device may be, for example, a smart phone, a tablet PC, a television, a monitor or the like.

As shown in FIG. 1, the light emitting display apparatus according to the present disclosure includes a display panel 100 provided with four non-display areas 103*a*, 103*b*, 103*c* and 103*d* outside a display area 102, a data driver 300 provided in the first non-display area 103*a* of the non-display areas to drive data lines DL1 to DLd formed in the display area 102 in a first direction (for example, vertical direction of the display panel), a gate driver 200 provided in the first non-display area 103*a* of the non-display area to drive gate lines GL1 to GLg formed in the display area in a second direction (for example, horizontal direction of the display panel) different from the first direction, and a controller 400 for controlling the data driver 300 and the gate driver 200. In this case, 'g' and 'd' are natural numbers, particularly 'g' and 'd' are even numbers. The controller 400 includes controller circuitry, and may be referred to as the controller circuitry 400.

First of all, the display panel 100 includes the display area 102 and the non-display area 103 surrounding the display area.

The display area 102 is provided with the gate lines GL1 to GLg, the data lines DL1 to DLd and connection lines CL.

The non-display area 103 may be provided with the gate driver 200, the data driver 300, and the controller 400. The non-display area includes a first non-display area 103*a*, a second non-display area 103*b*, a third non-display area 103*c* and a fourth non-display area 103*d*.

The first non-display area 103*a* faces the second non-display area 103*b* with the display area 102 interposed therebetween, and the third non-display area 103*c* faces the fourth non-display area 103*d* with the display area 102 interposed therebetween. One ends of the third non-display area 103*c* and the fourth non-display area 103*d* are connected to both ends of the first non-display area 103*a*, and the other ends of the third non-display area 103*c* and the fourth non-display area 103*d* are connected to both ends of the second non-display area 103*b*.

The gate lines GL1 to GLg connected with the connection lines CL extended from the gate driver 200 are provided in a second direction different from a first direction in which the connection lines CL are provided.

In this case, the first direction may be a vertical direction of the display panel as described above, and in this case, the data lines DL1 to DLa and the connection lines CL are provided in the display panel 100 along the first direction, namely, they extend along the first direction. The second direction may be a horizontal direction of the display panel, and the gate lines GL1 to GLg are provided in the display panel 100 along the second direction. It should be understood that "provided" includes the meaning of "extends." For example, the connection lines CL, which are "provided" in the first direction (e.g., the vertical direction) are illustrated as extending in the first direction, while the connection lines CL may be arranged in parallel in the second direction (e.g., the horizontal direction). The gate lines GL1 to GLg extend in the second direction (e.g., the horizontal direction) and are arranged in parallel in the first direction (e.g., the vertical direction).

The display panel 100 may be a light emitting display panel comprising pixels, as shown in FIG. 2A, or may be a liquid crystal display panel comprising pixels as shown in FIG. 2B.

When the display panel 100 is a light emitting display panel that includes pixels 101 shown in FIG. 2A, the pixel 101 provided in the display panel 100 may include a light emitting element ED, a switching transistor Tsw1, a storage capacitor Cst, a driving transistor Tdr and a sensing transistor Tsw2. That is, the pixel 101 may include a pixel driving unit PDU and a light emitting unit, wherein the pixel driving unit PDU may include a switching transistor Tsw1, a storage capacitor Cst, a driving transistor Tdr and a sensing transistor Tsw2. The light emitting unit may include a light emitting element ED. The pixel driving unit PDU may be pixel driving circuitry, and may be referred to as the pixel driving circuitry PDC. The light emitting unit may be light emitting circuitry, and may be referred to as the light emitting circuitry.

The switching transistor Tsw1 of the pixel driving unit PDU may be turned on or off by a gate signal GS supplied to the gate line GL. A data voltage Vdata supplied through the data line DL is supplied to the driving transistor Tdr when the switching transistor Tsw1 is turned on. A first voltage EVDD may be supplied to the driving transistor Tdr and the light emitting element ED through a first voltage supply line PLA. A second voltage EVSS is supplied to the light emitting element ED through a second voltage supply line PLB. The sensing transistor Tsw2 may be turned on or off by a sensing control signal SS supplied through a sensing control line SCL. A sensing line SL may be connected to the sensing transistor Tsw2. A reference voltage Vref may be supplied to the pixel 101 through the sensing line SL. A sensing signal related to a characteristic change of the driving transistor Tdr may be transmitted to the sensing line SL through the sensing transistor Tsw2.

When the display panel 100 is a liquid crystal display panel that includes pixels 101 shown in FIG. 2B, the pixel 101 provided in the display panel 100 may include a switching transistor Tsw1, a common electrode, and a liquid crystal. For example, the pixel 101 may include a pixel driving unit PDU and a light emitting unit. The pixel driving unit PDU may include a switching transistor Tsw1, and a common electrode to which a common voltage Vcom is supplied. In FIG. 2B, an element labeled by reference numeral Clc is a storage capacitance formed in a liquid crystal by a common voltage Vcom supplied to a common electrode and a pixel voltage supplied to a pixel electrode connected with the switching transistor Tsw1.

When the display panel 100 is a liquid crystal display panel, the display apparatus may further include a backlight that outputs light to the liquid crystal display panel.

The display panel 100 applied to the present disclosure may be formed in the structure shown in FIGS. 2A and 2B, but the present disclosure is not limited thereto. Therefore, the display panel 100 applied to the present disclosure may be changed in various forms in addition to the structures shown in FIGS. 2A and 2B.

The data driver 300 supplies data voltages Vdata to the data lines DL1 to DLd.

The data driver 300 may be provided in a film 500 attached to the first non-display area 102*a* of the display panel 100, and may be mounted in the display panel 100.

Next, the gate driver 200 supplies gate signals GS to the gate lines GL1 to GLg.

The gate driver 200 may be configured as an integrated circuit and then provided in the first non-display area 103*a*, or may be provided in the film 500. Also, the gate driver 200 may directly be embedded in the first non-display area 103*a* using a gate-in-panel (GIP) scheme.

When the data driver 300 is provided in the film 500, the gate driver 200 may also be provided in the film 500. Also, when the data driver 300 is provided in the first non-display area 103*a*, the gate driver 200 may directly be embedded in the first non-display area 103*a* using the gate-in-panel (GIP) scheme, or may be configured as an integrated circuit (IC) and then provided in the first non-display area 103*a*.

When a gate pulse generated by the gate driver 200 is supplied to a gate of the switching transistor Tsw1 provided in the pixel 101, the switching transistor Tsw1 is turned on. When a gate-off signal is supplied to the switching transistor Tsw1, the switching transistor Tsw1 is turned off. The gate signal GS supplied to the gate line GL includes a gate pulse and a gate-off signal.

The gate pulses GP supplied from the gate driver 200 to the gate lines GL1 to GLg through the connection lines CL are alternately output from a first side and a second side of the gate lines GL1 to GLg.

In this case, the first side and the second side are divided from each other based on a center portion C of the gate lines as a boundary.

For example, in FIG. 1, a left side may be the first side A and a right side may be the second side B based on the center portion C of the gate lines as a boundary.

In this case, when a (k)th gate pulse is output from the first side A of a (k)th gate line connected with the connection line CL provided in the first side A, a (k+1)th gate pulse is output from a second side B of a (k+1)th gate line connected with a (k+1)th connection line CL provided in the second side B. In this case, 'k' is a natural number smaller than 'g'. For example, as illustrated in FIG. 1, a $1^{st}$ gate line GL1 is connected with a connection line CL on the first side A, a $2^{nd}$ gate line GL2 is connected with a connection line CL on the second side B, and a $3^{rd}$ gate line GL3 is connected with a connection line CL on the first side A.

However, two gate pulses GP continuously output from the center portion C of the gate lines GL1 to GLg may be output from the first side A or the second side B.

A detailed configuration and function of the gate driver 200 will be described in detail with reference to FIGS. 4 to 8.

Next, as shown in FIG. 3, the controller 400 may include a data aligner 430 for realigning input image data Ri, Gi and Bi transmitted from an external system using a timing synchronization signal TSS transmitted from the external system and supplying the realigned image data Data to the data driver 300, a control signal generator 420 for generating a gate control signal GCS and a data control signal DCS using the timing synchronization signal TSS, an input unit 410 for receiving the timing synchronization signal TSS and the input image data Ri, Gi and Bi transmitted from the external system and transmitting them to the data aligner 430 and the control signal generator 420, and an output unit 440 for outputting the image data Data generated from the data aligner 430 and the control signals DCS and GCS generated from the control signal generator 420 to the data driver 300 or the gate driver 200. The input unit 410 may be input circuitry, and may be referred to as input circuitry 410. The output unit 440 may be output circuitry, and may be referred to as output circuitry 440.

The gate control signals GCS generated from the controller 400 include a gate start pulse, a gate shift clock and a gate output enable signal GOE.

Finally, the external system serves to drive the controller 400 and the electronic device. That is, when the electronic device is a smart phone, a tablet PC, a television, a monitor, etc., the external system may receive various kinds of voice information, image information and text information through a wireless communication network or a wired communication network, and may transmit the received image information to the controller 400. The image information may be the input image data Ri, Gi and Bi.

Figure 4:
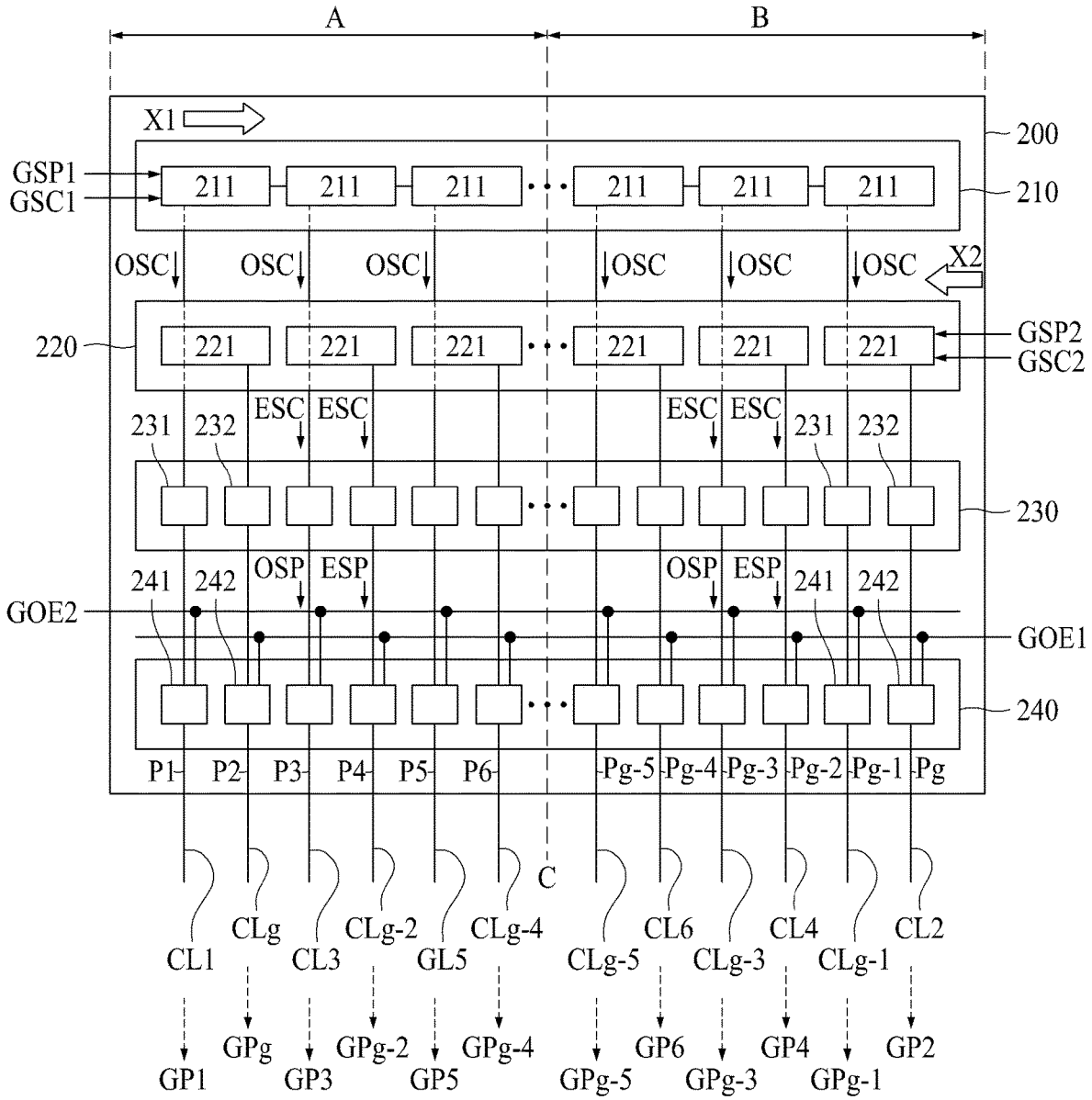
FIG. 4 is a view illustrating an inner configuration of a gate driver applied to a display apparatus according to the present disclosure.
Figure 5:
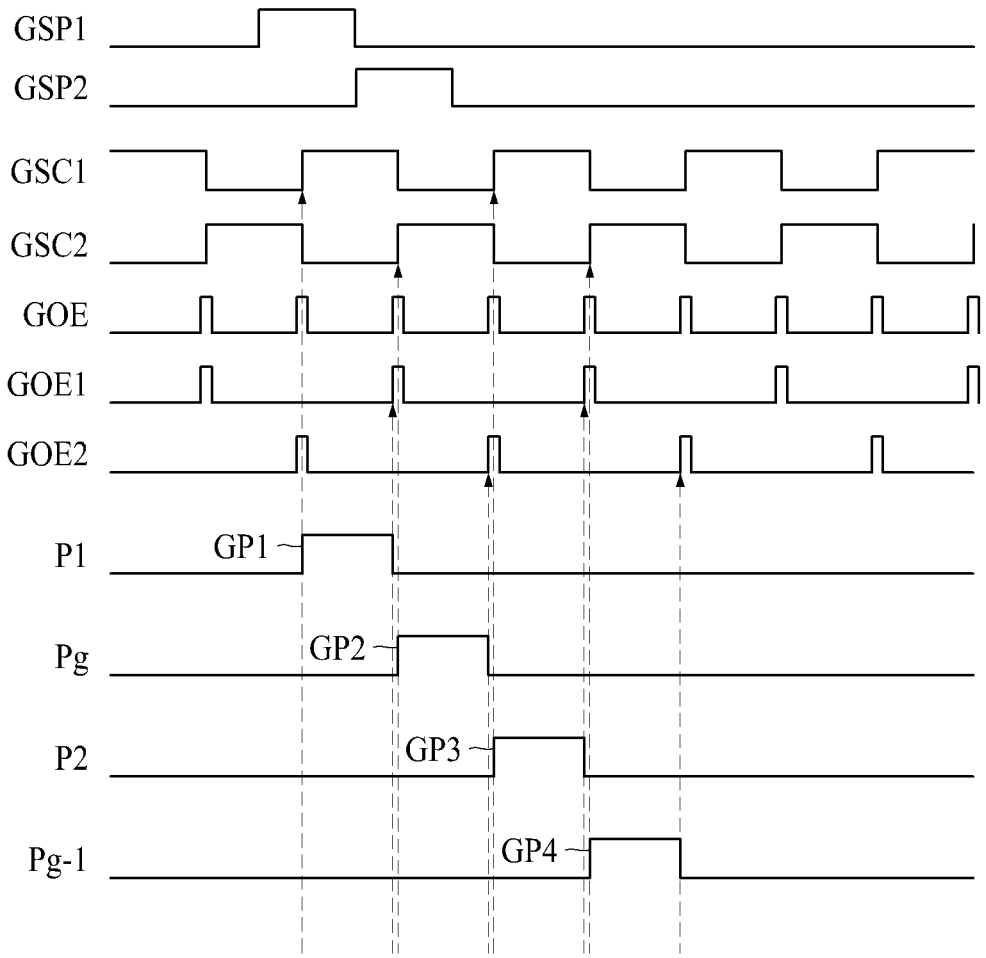
FIG. 5 illustrates waveforms of various signals applied to a display apparatus according to the present disclosure.

FIG. 4 is a view illustrating an inner configuration of a gate driver applied to a display apparatus according to the present disclosure, and FIG. 5 illustrates waveforms of various signals applied to a display apparatus according to the present disclosure.

The gate driver 200 applied to the present disclosure includes at least one gate driver IC. Hereinafter, a light emitting display apparatus including one gate driver IC will be described with reference to FIGS. 1 to 5. When the gate driver 200 includes one gate driver IC (GIC), the gate driver 200 may be a gate driver IC (GIC).

The gate driver 200, that is, the gate driver IC GIC, as show in FIG. 4, includes an odd shift register 210 including odd flip-flops 211 driven in a second side direction from a first side direction (e.g., as illustrated by arrow X1) of the gate driver 200, an even shift register 220 including even flip-flops 221 driven in the first side direction from the second side direction (e.g., as illustrated by arrow X2) of the gate driver 200, a level shifter unit 230 for amplifying odd shift clocks and even shift clocks, which are sequentially transmitted from the odd shift register 210 and the even shift register 220, and sequentially outputting the amplified shift clocks, and a buffer unit 240 for sequentially outputting the gate pulses GP amplified by the level shifter unit 230 to the gate lines GL1 to GLg. The level shifter unit 230 may be level shifter circuitry, and may be referred to as level shifter circuitry 230. The buffer unit 240 may be buffer circuitry, and may be referred to as buffer circuitry 230.

In this case, as described above, the first side A may be a left side based on the center portion C of the gate lines as a boundary, and the second side B may be a right side based on the center portion C of the gate lines as a boundary. When the gate driver 200 is aligned at the center portion C of the gate lines, the left side of the gate driver 200 may be the first side A, and the right side thereof may be the second side B.

The second side direction from the first side direction may refer to an arrow direction shown as X1 in FIG. 4, for example, and the first side direction from the second side direction may refer to an arrow direction shown as X2 in FIG. 4.

Therefore, in the following description, the second side direction from the first side direction refers to a direction oriented from the left side to the right side of the display panel 100, the gate driver 200, the gate driver IC (GIC), or a combination thereof and the first side direction from the second side direction refers to a direction oriented from the right side to the left side of the display panel 100, the gate driver 200, the gate driver IC (GIC), or a combination thereof.

The odd shift register 210 includes odd flip-flops 211. The odd flip-flops 211 are sequentially driven from the first side direction to the second side direction (X1 direction) to sequentially output the odd shift clocks OSC.

The even shift register 220 includes even flip-flops 221. The even flip-flops 221 are sequentially driven from the second side direction to the first side direction (X2 direction) to sequentially output the even shift clocks ESC.

For example, the odd shift register 210 is driven when an odd gate start pulse GSP1 is supplied as shown in FIG. 4 and in the waveform diagram of FIG. 5. The odd gate start pulse GSP1 is an odd start control signal. The odd gate start pulse GSP1 may be one of the gate control signals GCS generated by the controller 400. That is, the controller 400 may generate the odd gate start pulse GSP1 by using the timing synchronization signal TSS. However, the odd gate start pulse GSP1 may be generated directly from the gate driver 200 by using the gate shift clock GSC generated by the controller 400.

The even shift register 220 is driven when an even gate start pulse GSP2 is supplied as shown in FIG. 4 and in the waveform diagram of FIG. 5. The even gate start pulse GSP2 is an even start control signal. The even gate start pulse GSP2 may be one of the gate control signals GCS generated by the controller 400. That is, the controller 400 may generate the even gate start pulse GSP2 by using the timing synchronization signal TSS. However, the even gate start pulse GSP2 may be generated directly from the gate driver 200 by using the gate shift clock GSC generated by the controller 400.

When a time period for outputting a high level of the odd gate start pulse GSP1 is referred to as a two-horizontal period, a time period at which a high level of the even gate start pulse GSP2 is output is also referred to as a two-horizontal period. After the odd gate start pulse GSP1 having a high level is supplied to the odd shift register 210, the even gate start pulse GSP2 having a high level is supplied to the even shift register 220.

The odd shift register 210 generates odd shift clocks OSC by using the odd gate shift clock GSC1. A high-level width of the odd gate shift clock GSC1 may be a two-horizontal period 2H.

For example, the odd flip-flops 211 of the odd shift register 210 may sequentially output signals corresponding to a high level of the odd gate shift clock GSC1. The signal output from each of the odd flip-flops 211 is referred to as an odd shift clock OSC.

The even shift register 220 generates even shift clocks ESC by using an even gate shift clock GSC2. A high-level width of the even gate shift clock GSC2 may be a two-horizontal period 2H.

For example, the even flip-flops 221 of the even shift register 220 may sequentially output signals corresponding to the high level of the even gate shift clock GSC2. The signal output from each of the even flip-flops 221 is referred to as an even shift clock ESC.

In more detail, when the odd flip-flop provided at the end of the first side of the odd flip-flops 211 of the odd shift register 210 is driven by the odd gate start pulse GSP1 supplied from the first side, the odd flip-flops 211 provided from the first side to the second side are sequentially driven to sequentially output the odd shift clocks OSC. For example, the odd shift clock OSC corresponding to the $1^{st}$ gate pulse GP1 may be outputted, then the odd shift clock OSC corresponding to the $3^{rd}$ gate pulse GP3 may be outputted, then the odd shift clock OSC corresponding to the $5^{th}$ gate pulse GP5 may be outputted.

Also, when the even flip-flop provided at the end of the second side of the even flip-flops 221 of the even shift register 220 is driven by the even gate start pulse GSP2 supplied from the second side, the even flip-flops 221 provided from the second side to the first side are sequentially driven to sequentially output the even shift clocks ESC. For example, the even shift clock ESC corresponding to the $2^{nd}$ gate pulse GP2 may be outputted, then the even shift clock ESC corresponding to the $4^{th}$ gate pulse GP4 may be outputted, then the even shift clock ESC corresponding to the $6^{th}$ gate pulse GP6 may be outputted.

In this case, the odd flip-flops 211 and the even flip-flops 221 are alternately driven. Therefore, the odd shift clocks OSC and the even shift clocks ESC are alternately output.

Next, the level shifter unit 230 amplifies the odd shift clocks OSC and the even shift clocks ESC, which are sequentially transmitted from the odd shift register 211 and the even shift register 221, and sequentially outputs the amplified odd and even shift clocks OSC and ESC.

To this end, the level shifter unit 230 includes level shifters connected with the odd flip-flops 211 and the even flip-flops 221.

The odd flip-flops 211 are connected to odd level shifters 231 of the level shifters, and the even flip-flops 221 are connected to even level shifters 232 of the level shifters.

Finally, the buffer unit 240 sequentially outputs shift pulses sequentially supplied from the level shifter unit 230 to the gate lines GL1 to GLg in accordance with a first gate output enable signal GOE1 and a second gate output enable signal GOE2.

A pulse width of the gate pulse GP is equal to a pulse width of the odd shift clock OSC and a pulse width of the even shift clock ESC.

The buffer unit 240 includes buffers for storing the shift pulses sequentially supplied from the level shifter unit 230.

The odd level shifters 231 are connected to odd buffers 241 among the buffers and the even level shifters 232 are connected to even buffers 242.

Odd shift pulses OSP are stored in the odd buffers 241, and even shift pulses ESP are stored in the even buffers 242. In this case, the odd shift pulses OSP and the even shift pulses ESP are gate pulses. That is, for convenience of description, signals supplied to the buffers 241 and 242 will be referred to as odd shift pulses OSP and even shift pulses ESP, and signals output from the buffers 241 and 242 will be referred to as gate pulses.

The first gate output enable signal GOE1 and the second gate output enable signal GOE2 are supplied to the even buffers 242 and the odd buffers 241.

In the present disclosure, as shown in FIG. 5, when the first gate shift clock GSC1 descends from a high level to a low level or when the second gate shift clock GSC2 rises from a low level to a high level, the pulse of the first gate output enable signal GOE1 is output to the even buffers 242, and when the second gate shift clock GSC2 descends from a high level to a low level or when the first gate shift clock GSC1 rises from a low level to a high level, the pulse of the second gate output enable signal GOE2 is output to the odd buffers 241.

The first gate output enable signal GOE1 and the second gate output enable signal GOE2 may be generated by a gate output enable signal GOE as shown in FIG. 5. The gate output enable signal GOE may be generated by the controller 400. The first gate output enable signal GOE1 and the second gate output enable signal GOE2 may be generated by the controller 400 and then transmitted to the gate driver 200, and may be generated using the gate output enable signal GOE in the gate driver 200.

In this case, the odd gate pulses generated by the odd shift clocks OSC are output to odd gate lines among the gate lines through odd connection lines among the connection lines CL. Also, even gate pulses generated by the even shift clocks ESC are output to even gate lines among the gate lines through even connection lines among the connection lines CL.

In this case, when first to (g)th ports P1 to Pg of the gate driver are connected to the buffers 241 and 242 provided from the first side A (left side) to the second side B (right side) of the buffer unit 240 in a one-to-one relationship as shown in FIG. 4, the first port P1 is connected with the first gate line GL1 through the first connection line CL1, the second port P2 is connected to the (g)th gate line CLg through a (g)th gate connection line CLg, a (g−1)th port Pg−1 is connected to a (g−1)th gate line GLg−1 through a (g−1)th connection line Clg−1, and a (g)th port Pg is connected to the second gate line GL2 through the second connection line CL2.

Among the odd buffers 241, the buffer connected with the first port P1 is first driven to output the first gate pulse GP1. The first port P1 is connected with the first gate line GL1 through the first connection line CL1. Therefore, the first gate pulse GP1 output from the first port P1 is output to the first gate line GL1 through the first connection line CL1. Afterwards, the odd buffers 241 are sequentially driven from the first side A to sequentially output the gate pulses.

Among the even buffers 242, the buffer connected with the (g)th port Pg is first driven to output the second gate pulse GP2. The (g)th port Pg is connected with the second gate line GL2 through the second connection line CL2. Therefore, the second gate pulse GP2 output from the (g)th port Pg is output to the second gate line GL2 through the second connection line CL2. Afterwards, the even buffers 242 are sequentially driven from the second side B to sequentially output the gate pulses.

In this case, the odd buffers 241 and the even buffers 242 are alternately driven. Therefore, the gate pulses supplied to the odd gate lines and the gate pulses supplied to the even gate lines are alternately output. For example, as illustrated in FIG. 5, the first port P1 (e.g., on the first side A) is driven to output the first gate pulse GP1, then the (g)th port Pg (e.g., on the second side B) is driven to output the second gate pulse GP2, then a second port P2 (e.g., on the first side A) is driven to output a third gate pulse GP3.

The odd buffer 241 is driven by the second gate output enable signal GOE2 to output an odd gate pulse, and the even buffer 242 is driven by the first gate output enable signal GOE1 to output an even gate pulse.

In this case, the connection lines CL connected with the odd buffers 241 and the even buffers 242, which are provided in the first side A of the gate driver 200, are connected to the first side of the gate lines GL1 to GLg. The connection lines CL connected with other odd buffers 241 and other even buffers 242, which are provided in the second side B of the gate driver 200, are connected to the second side of the gate lines GL1 to GLg.

Therefore, the gate pulses GP1 to GPg supplied from the gate driver 200 to the gate lines GL1 to GLg through the connection lines CL may alternately be output to the first side and the second side of the gate lines.

The method of alternately outputting the gate pulses to the first side and the second side of the gate lines will be described below with reference to FIGS. 6 to 8.

Figure 6:
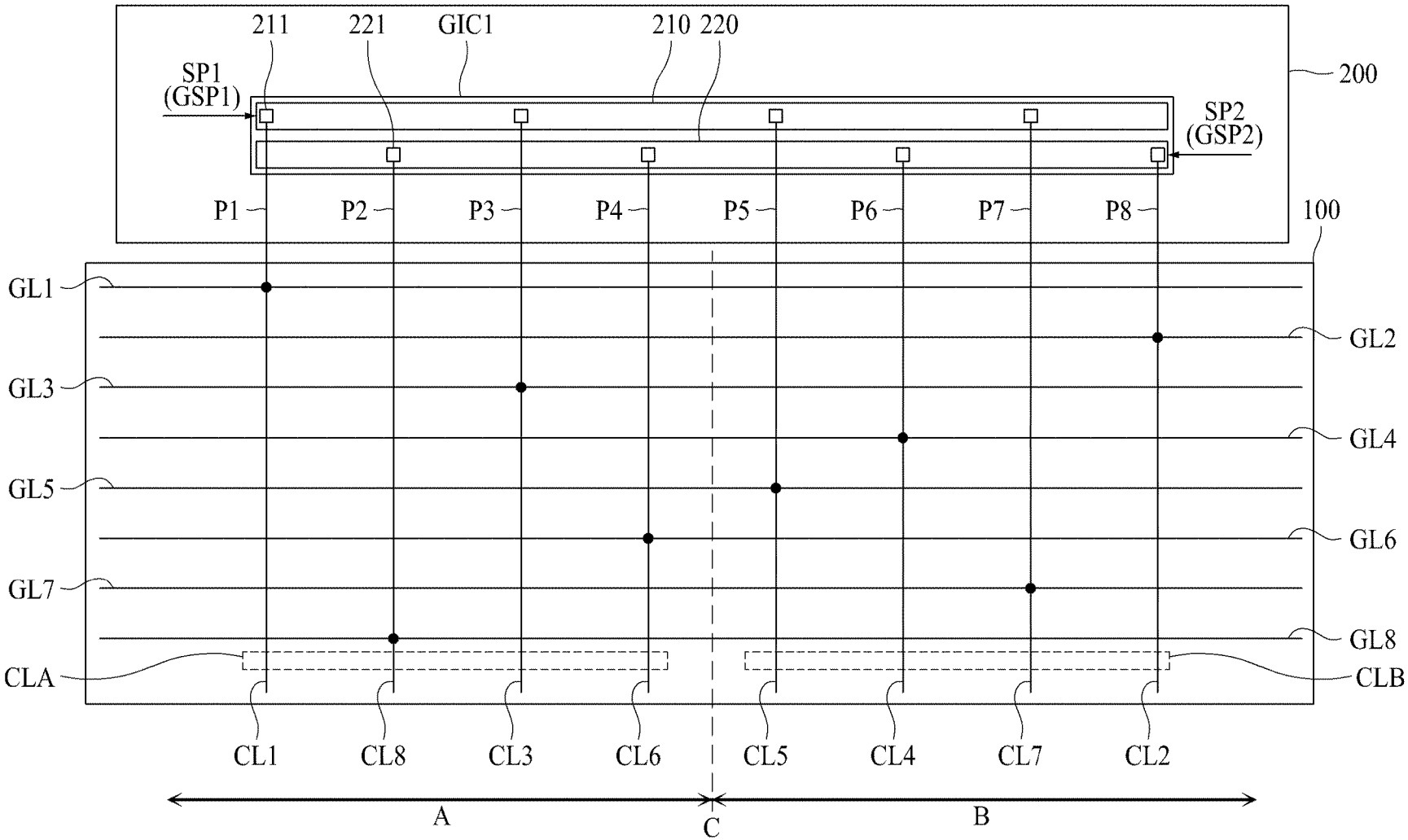
FIG. 6 is a view illustrating a connection relationship of connection lines and gate lines, which are applied to a display apparatus according to the present disclosure.

FIG. 6 is a view illustrating a connection relationship of connection lines and gate lines, which are applied to a display apparatus according to the present disclosure. Particularly, FIG. 6 illustrates a display panel provided with eight gate lines. That is, the display panel provided with eight gate lines will be described as an example of the present disclosure.

In the present disclosure, as described above, gate pulses GP supplied from the gate driver 200 to the gate lines GL through the connection lines CL are alternately output to the first and second sides of the gate lines GL.

To this end, as shown in FIG. 6, first side connection lines CLA connected with the gate driver 200 at the first side A of the connection lines CL are connected to the first side A of the gate lines GL1, and second side connection lines CLB connected with the gate driver 200 at the second side B of the connection lines CL are connected to the second side B of the gate lines GL.

Also, the first side connection lines CLA are alternately connected to odd gate lines and even gate lines among the gate lines GL1, and the second side connection lines CLB are alternately connected to another odd gate lines and another even gate lines of the gate lines GL.

In more detail, the display panel 100 includes first to (g)th connection lines CL1 to CLg connected with the gate driver 200, and first to (g)th gate lines GL1 to GLg connected with the first to (g)th connection lines CL1 to CLg.

The first side connection lines CLA of the connection lines CL1 to CLg are connected to odd gate lines of the first to ((g/2)−1)th gate lines GL1 to GL(g/2)−1 and even gate lines of (g)th to ((g/2)+2)th gate lines GLg to GL(g/2)+2. For example, when g is 8, as shown in FIG. 6, the first side connection lines CLA of the connection lines CL1 to CL8 are connected to odd gate lines of the first to $3^{rd}$ gate lines GL1 to GL3 and even gate lines of $8^{th}$ to $6^{th}$ gate lines GL8 to GL6.

The second side connection lines CLB of the connection lines CL1 to CLg are connected to odd gate lines of ((g/2)+1)th to (g)th gate lines GL(g/2)+1 to GLg and even gate lines of (g/2)th to first gate lines GL(g/2) to GL1. For example, when g is 8, as shown in FIG. 6, the second side connection lines CLB of the connection lines CL1 to CL8 are connected to odd gate lines of $5^{th}$ to $8^{th}$ gate lines GL5 to GL8 and even gate lines of $4^{th}$ to first gate lines GL4 to GL1.

In the case, the first side connection lines CLA are alternately connected to the odd gate lines of the first to ((g/2)−1)th gate lines and the even gate lines of the (g)th to ((g/2)+2)th gate lines.

The second side connection lines CLB are alternately connected to the odd gate lines of and the ((g/2)+1)th to (g)th gate lines and the even gate lines of the (g/2)th to first gate lines.

The structure described as above will be described below with reference to FIG. 6. For convenience of description, FIG. 6 illustrates a display panel 100 provided with eight gate lines GL1 to GL8.

That is, eight connection lines CL1 to CL8 connected with the eight gate lines GL1 to GL8 are provided in FIG. 6.

In this case, the first connection line CL1, the eighth connection line CL8, the third connection line CL3 and the sixth connection line CL6 are included in the first side connection lines CLA. The fifth connection line CL5, the fourth connection line CL4, the seventh connection line CL7 and the second connection line CL2 are included in the second side connection lines CLB.

The first connection line CL1, the eighth connection line CL8, the third connection line CL6, the sixth connection line CL6, the fifth connection line CL5, the fourth connection line CL7, the seventh connection line CL7 and the second connection line CL2 are connected to the first to eighth ports P1 to P8 of the gate driver 200.

That is, the first connection line CL1 is connected to the first port P1, the eighth connection line CL8 is connected to the second port P2, the third connection line CL3 is connected to the third port P3, the sixth connection line CL6 is connected to the fourth port P4, the fifth connection line CL5 is connected to the fifth port P5, the connection line CL4 is connected to the sixth port P6, the seventh connection line CL7 is connected to the seventh port P7, and the second connection line CL2 is connected to the eighth port P8.

Numbers of the ports P are sequentially given from the first side A to the second side B of the gate driver 200, and numbers of the connection lines CL correspond to numbers of the gate lines GL to which the connection lines CL are connected. That is, the first connection line CL1 connected to the first port P1 is connected to the first gate line GL1, and the second connection line CL2 connected to the eighth port P8, which is the last port, is connected to the second gate line GL2.

In this case, the odd ports are connected to the odd shift register 210, and the even ports are connected to the even shift register 220.

Particularly, the ports P are substantially connected to the buffers 241 and 242, as shown in FIG. 4, but for convenience of description, the ports are connected to the odd shift register 210 and the even shift register 220 in FIG. 6. In other words, FIG. 6 shows the relationship of the odd shift register 210, the even shift register 220, the ports P and the connection lines CL.

In more detail, as shown in FIG. 4, the gate pulses generated by the odd shift clock OSC supplied from the odd shift register 210 are output to the odd ports through the odd buffers 241, and the gate pulses generated by the even shift clock ESC supplied from the even shift register 220 are output to the even ports through the even buffers 242.

Therefore, for convenience of description, odd ports connected to the odd shift registers 210 and even ports connected to the even shift registers 220 are shown in FIG. 6.

That is, as shown in FIG. 6, the first connection line CL1, the eighth connection line CL8, the third connection line CL3 and the sixth connection line CL6, which are included in the first side connection lines CLA, are connected to the first gate line GL1, the eighth gate line GL8, the third gate line GL3 and the sixth gate line GL6.

In this case, the first side connection lines CLA are alternately connected to the odd gate lines and the even gate lines.

Also, as shown in FIG. 6, the fifth connection line CL5, the fourth connection line CL4, the seventh connection line CL7 and the second connection line CL2, which are included in the second side connection lines CLA, are connected to the fifth gate line GL5, the fourth gate line GL4, the seventh gate line GL7 and the second gate line GL2.

In this case, the second side connection lines CLB are also alternately connected to the odd gate lines and the even gate lines.

The order in which the gate pulses are output in the light emitting display apparatus having the structure described as above will be described as follows.

First, the first gate pulse output through the first connection line CL1 connected to the first port P1 is output through the first side of the first gate line GL1.

Next, the second gate pulse output through the second connection line CL2 connected to the eighth port P8 is output through the second side of the second gate line GL2.

The third gate pulse output through the third connection line CL3 connected to the third port P3 is output through the first side of the third gate line GL3.

The fourth gate pulse output through the fourth connection line CL4 connected to the sixth port P6 is output through the second side of the fourth gate line GL4.

Next, the fifth gate pulse output through the fifth connection line CL5 connected to the fifth port P5 is output through the second side of the fifth gate line GL5.

Next, the sixth gate pulse output through the sixth connection line CL6 connected to the fourth port P4 is output through the first side of the sixth gate line GL6.

Next, the seventh gate pulse output through the seventh connection line CL7 connected to the seventh port P7 is output through the second side of the seventh gate line GL7.

Finally, the eighth gate pulse output through the eighth connection line CL8 connected to the second port P2 is output through the first side of the eighth gate line GL8.

According to the present disclosure described as above, the gate pulses GP supplied from the gate driver 200 to the gate lines GL through the connection lines CL are alternately output to the first and second sides of the gate lines GL.

In this case, two gate pulses continuously output to two connection lines provided in the center portion C of the gate lines GL may be output from the first side or output from the second side.

For example, in FIG. 6, the fourth gate pulse and the fifth gate pulse continuously output through the fourth connection line CL4 and the fifth connection line CL5 are output from the second side B of the fourth gate line GL4 and the fifth gate line GL5.

Figure 7:
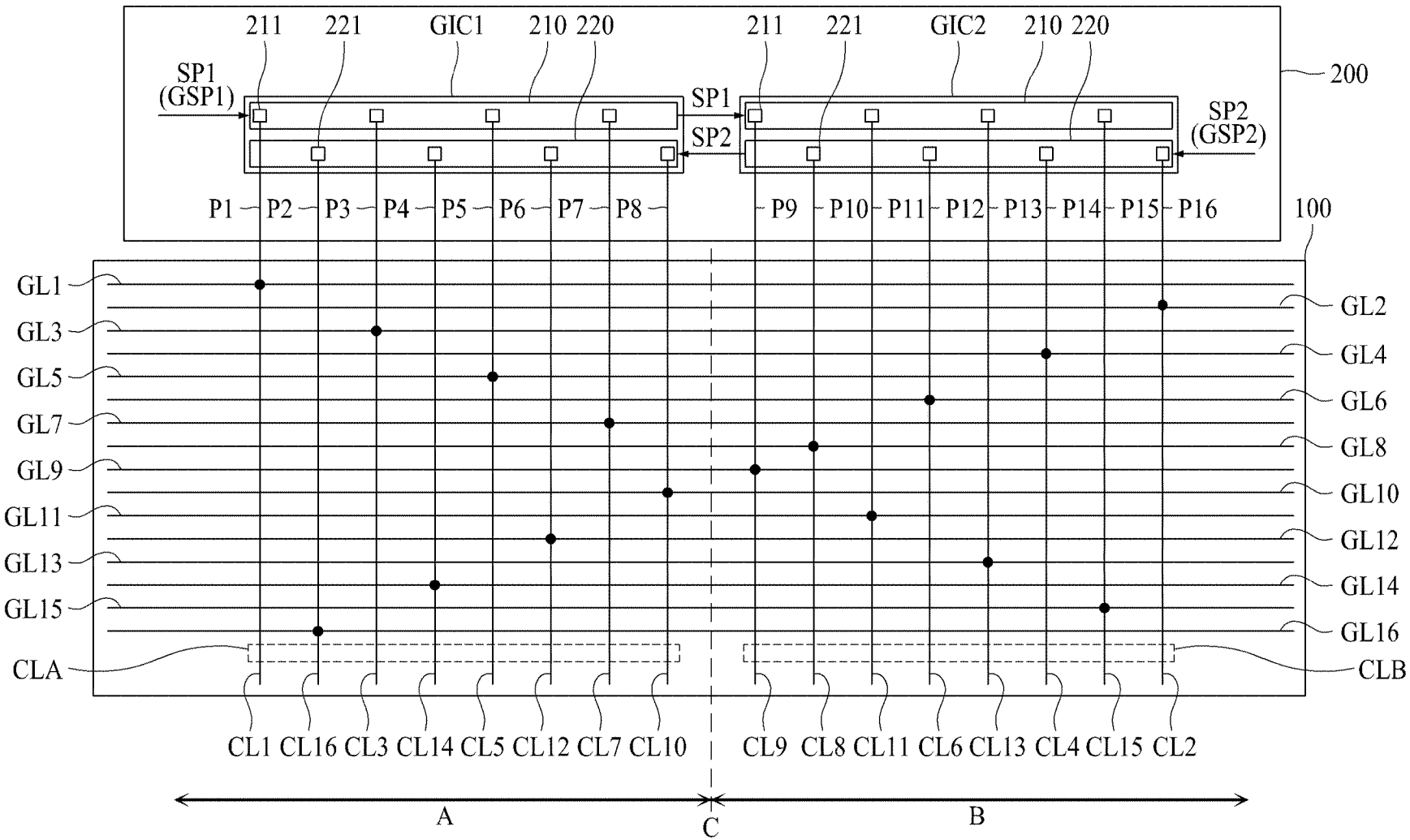
FIG. 7 is another view illustrating a connection relationship of connection lines and gate lines, which are applied to a display apparatus according to the present disclosure.

FIG. 7 is another view illustrating a connection relationship of connection lines and gate lines, which are applied to a display apparatus according to the present disclosure. Particularly, FIG. 7 illustrates a display panel provided with sixteen gate lines. That is, the display panel provided with sixteen gate lines will be described as an example of the present disclosure. Also, the gate driver 200 shown in FIG. 7 includes two gate driver ICs (GICs). In the following description, the same or similar description as or to that described with reference to FIGS. 1 to 6 will be omitted or briefly described.

As described above, the gate driver 200 according to one embodiment of the present disclosure may include at least two gate driver ICs GIC1 and GIC2.

As shown in FIG. 4, each of at least two gate driver ICs GIC1 and GIC2 includes an odd shift register 210, an even shift register 220, a level shifter unit 230 and a buffer unit 240.

In this case, when at least two gate driver ICs include first to (n)th gate driver ICs (n is a natural number) provided in the second side direction from the first side (A) direction, the first to (n)th gate driver ICs are driven by a start control signal transmitted from the gate driver IC adjacent thereto or the controller 400.

The odd shift register provided in an (m)th gate driver IC is driven in accordance with an odd start control signal SP1 transmitted from the odd shift register provided in a (m−1)th gate driver IC, and the even shift register provided in the (m−1)th gate driver IC is driven in accordance with an even start control signal SP2 transmitted from the even shift register provided in the (m)th gate driver IC, wherein 'm' is less than or equal to 'n'.

For example, as shown in FIG. 7, when the gate driver 200 includes two gate driver ICs GIC1 and GIC2, the odd shift register 210 provided in the second gate driver IC GIC2 is driven in accordance with the odd start control signal SP1 transmitted from the odd shift register 210 provided in the first gate driver IC GIC1. The even shift register 220 provided in the first gate driver IC GIC1 is driven in accordance with the even start control signal SP2 transmitted from the even shift register 220 provided in the second gate driver IC GIC2.

In this case, the odd shift register 210 provided in the first gate driver IC GIC1 is driven in accordance with the odd start control signal SP1 transmitted from the controller 400, that is, the odd gate start pulse GSP1, and the even shift register 220 provided in the second gate driver IC GIC2 is driven in accordance with the even start control signal SP2 transmitted from the controller 400, that is, the even gate start pulse GSP2.

In the present disclosure, as described above, the gate pulses GP supplied from the gate driver 200 to the gate lines GL through the connection lines CL are alternately output to the first and second sides of the gate lines GL.

Hereinafter, the order in which the gate pulses are output in the light emitting display apparatus shown in FIG. 7 will be described.

First, the first gate pulse output through the first connection line CL1 connected to the first port P1 is output through the first side of the first gate line GL1.

Next, the second gate pulse output through the second connection line CL2 connected to the sixteenth port P16 is output through the second side of the second gate line GL2.

Next, the third gate pulse output through the third connection line CL3 connected to the third port P3 is output through the first side of the third gate line GL3.

Next, the fourth gate pulse output through the fourth connection line CL4 connected to the fourteenth port P14 is output through the second side of the fourth gate line GL4.

Next, the fifth gate pulse output through the fifth connection line CL5 connected to the fifth port P5 is output through the first side of the fifth gate line GL5.

Next, the sixth gate pulse output through the sixth connection line CL6 connected to the twelfth port P12 is output through the second side of the sixth gate line GL6.

Next, the seventh gate pulse output through the seventh connection line CL7 connected to the seventh port P7 is output through the first side of the seventh gate line GL7.

The eighth gate pulse output through the eighth connection line CL8 connected to the tenth port P10 is output through the second side of the eighth gate line GL8.

The ninth gate pulse output through the ninth connection line CL9 connected to the ninth port P9 is output through the second side of the ninth gate line GL9.

The tenth gate pulse output through the tenth connection line CL 10 connected to the eighth port P8 is output through the first side of the tenth gate line GL10.

The eleventh gate pulse output through the eleventh connection line CL11 connected to the eleventh port P11 is output through the second side of the eleventh gate line GL11.

Next, the twelfth gate pulse output through the twelfth connection line CL12 connected to the sixth port P6 is output through the first side of the twelfth gate line GL12.

Next, the thirteenth gate pulse output through the thirteenth connection line CL13 connected to the thirteenth port P13 is output through the second side of the thirteenth gate line GL13.

The fourteenth gate pulse output through the fourteenth connection line CL14 connected to the fourth port P4 is output through the first side of the fourteenth gate line GL14.

Next, the fifteenth gate pulse output through the fifteenth connection line CL15 connected to the fifteenth port P15 is output through the second side of the fifteenth gate line GL15.

Finally, the sixteenth gate pulse output through the sixteenth connection line CL16 connected to the second port P2 is output through the first side of the sixteenth gate line GL16.

According to the present disclosure described as above, the gate pulses GP supplied from the gate driver 200 to the gate lines GL through the connection lines CL are alternately output to the first and second sides of the gate lines GL.

In this case, the two gate pulses continuously output to the two connection lines provided in the center portion C of the gate lines GL may be output from the first side or output from the second side.

For example, in FIG. 7, the eighth gate pulse and the ninth gate pulse, which are sequentially output through the eighth connection line CL8 and the ninth connection line CL9, are output from the second side B of the eighth gate line GL8 and the ninth gate line GL9.

Figure 8:
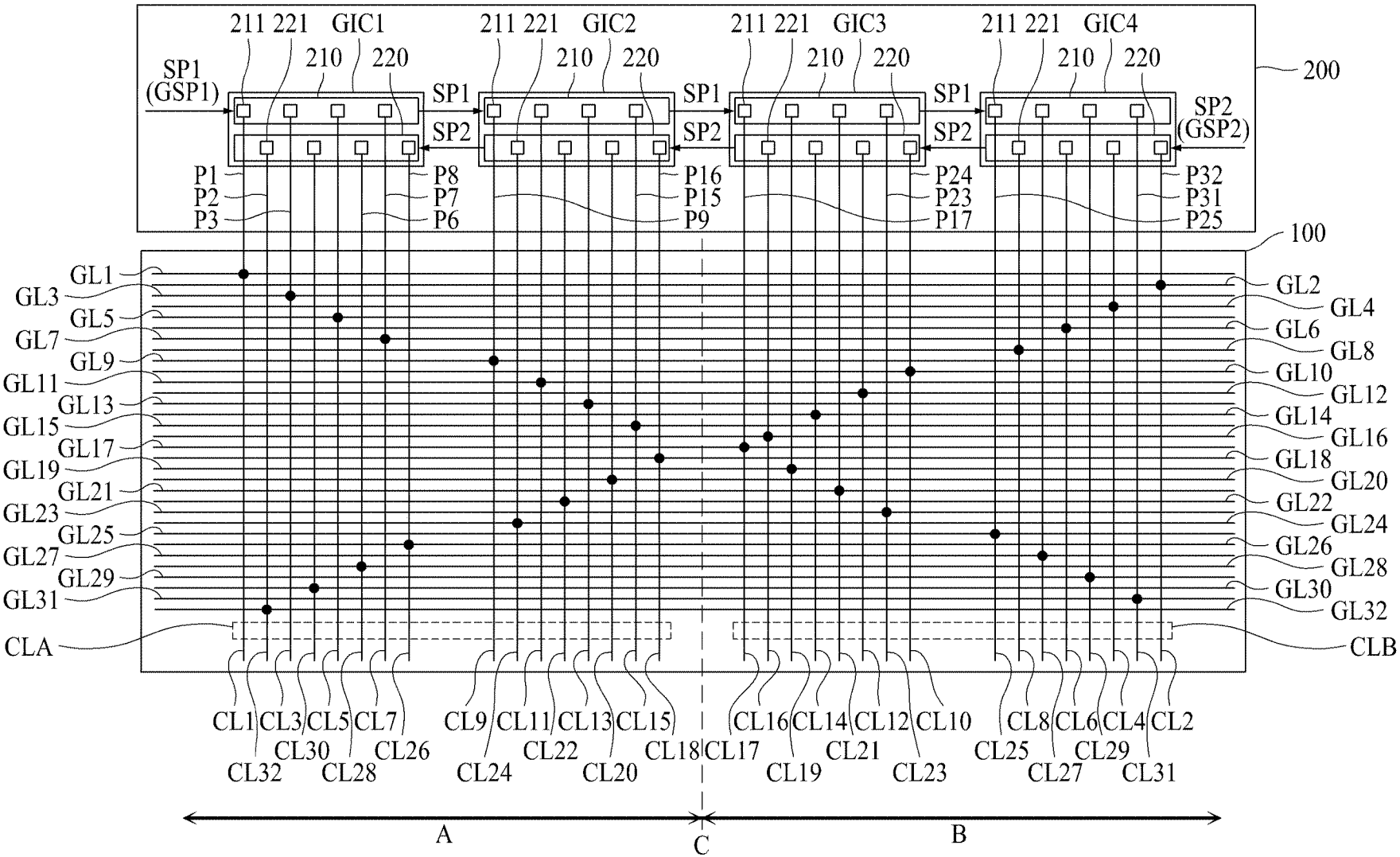
FIG. 8 is other view illustrating a connection relationship of connection lines and gate lines, which are applied to a display apparatus according to the present disclosure.

FIG. 8 is other view illustrating a connection relationship of connection lines and gate lines, which are applied to a display apparatus according to the present disclosure. Particularly, FIG. 8 illustrates a display panel provided with thirty-second gate lines. That is, the display panel provided with thirty-second gate lines will be described as an example of the present disclosure. Also, the gate driver 200 shown in FIG. 8 includes four gate driver ICs (GICs). In the following description, the same or similar description as or to that described with reference to FIGS. 1 to 7 will be omitted or briefly described.

As described above, the gate driver 200 applied to the present disclosure may include at least two gate driver ICs GIC1 and GIC2.

As shown in FIG. 4, each of the at least two gate driver ICs GIC1 and GIC2 includes an odd shift register 210, an even shift register 220, a level shifter unit 230 and a buffer unit 240.

In this case, when at least two gate driver ICs include the first to (n)th gate driver ICs (n is a natural number) provided in the second side direction from the first side (A) direction, the first to (n)th gate driver ICs are driven by the start control signal transmitted from the gate driver IC adjacent thereto or the controller 400.

The odd shift register provided in the (m)th gate driver IC is driven in accordance with the odd start control signal SP1 transmitted from the odd shift register provided in the (m−1)th gate driver IC, and the even shift register provided in the (m−1)th gate driver IC is driven in accordance with the even start control signal SP2 transmitted from the even shift register provided in the (m)th gate driver IC.

For example, as shown in FIG. 8, when the gate driver 200 includes four gate driver ICs GIC1, GIC2, GIC3 and GIC4, the odd shift register 210 provided in the first gate driver IC GIC1 is driven in accordance with the odd start control signal SP1 transmitted from the controller 400, that is, the odd gate start pulse GSP1, the odd shift register 210 provided in the second gate driver IC GIC2 is driven in accordance with the odd start control signal SP1 transmitted from the odd shift register 210 provided in the first gate driver IC GIC1, the odd shift register 210 provided in the third gate driver IC GIC3 is driven in accordance with the odd start control signal SP1 transmitted from the odd shift register 210 provided in the second gate driver IC GIC2, and the odd shift register 210 provided in the fourth gate driver IC GIC4 is driven in accordance with the odd start control signal SP1 transmitted from the odd shift register 210 provided in the third gate driver IC GIC3.

Also, the even shift register 220 provided in the fourth gate driver IC GIC4 is driven in accordance with the even start control signal SP2 transmitted from the controller 400, that is, the even gate start pulse GSP2, the even shift register 220 provided in the third gate driver IC GIC3 is driven in accordance with the even start control signal SP2 transmitted from the even shift register 220 provided in the fourth gate driver IC GIC4, the even shift register 220 provided in the second gate driver IC GIC2 is driven in accordance with the even start control signal SP2 transmitted from the even shift register 220 provided in the third gate driver IC GIC3, and the even shift register 220 provided in the first gate driver IC GIC1 is driven in accordance with the even start control signal SP2 transmitted from the even shift register 220 provided in the second gate driver IC GIC2.

In the present disclosure, as described above, the gate pulses GP supplied from the gate driver 200 to the gate lines GL through the connection lines CL are alternately output to the first and second sides of the gate lines GL.

Hereinafter, the order in which the gate pulses are output in the light emitting display apparatus shown in FIG. 8 will be described.

First, the first gate pulse output through the first connection line CL1 connected to the first port P1 is output through the first side of the first gate line GL1.

Next, the second gate pulse output through the second connection line CL2 connected to the third-second port P32 is output through the second side of the second gate line GL2.

Next, the third gate pulse output through the third connection line CL3 connected to the third port P3 is output through the first side of the third gate line GL3.

Next, the fourth gate pulse output through the fourth connection line CL4 connected to the thirtieth port P30 is output through the second side of the fourth gate line GL4.

Next, the fifth gate pulse output through the fifth connection line CL5 connected to the fifth port P5 is output through the first side of the fifth gate line GL5.

Next, the sixth gate pulse output through the sixth connection line CL6 connected to the twenty-eighth port P28 is output through the second side of the sixth gate line GL6.

Next, the seventh gate pulse output through the seventh connection line CL7 connected to the seventh port P7 is output through the first side of the seventh gate line GL7.

Next, the eighth gate pulse output through the eighth connection line CL8 connected to the twenty-sixth port P26 is output through the second side of the eighth gate line GL8.

The ninth gate pulse output through the ninth connection line CL9 connected to the ninth port P9 is output through the first side of the ninth gate line GL9.

The tenth gate pulse output through the tenth connection line CL 10 connected to the twenty-fourth port P24 is output through the second side of the tenth gate line GL10.

The eleventh gate pulse output through the eleventh connection line CL11 connected to the eleventh port P11 is output through the first side of the eleventh gate line GL11.

The twelfth gate pulse output through the twelfth connection line CL12 connected to the twenty-second port P22 is output through the second side of the twelfth gate line GL12.

Next, the thirteenth gate pulse output through the thirteenth connection line CL13 connected to the thirteenth port P13 is output through the first side of the thirteenth gate line GL13.

Next, the fourteenth gate pulse output through the fourteenth connection line CL14 connected to the twentieth port P20 is output through the second side of the fourteenth gate line GL14.

The fifteenth gate pulse output through the fifteenth connection line CL15 connected to the fifteenth port P15 is output through the first side of the fifteenth gate line GL15.

Next, the sixteenth gate pulse output through the sixteenth connection line CL16 connected to the eighteenth port P18 is output through the second side of the sixteenth gate line GL16.

Next, the seventeenth gate pulse output through the seventeenth connection line CL17 connected to the seventeenth port P17 is output through the second side of the seventeenth gate line GL17.

The eighteenth gate pulse output through the eighteenth connection line CL18 connected to the sixteenth port P16 is output through the first side of the eighteenth gate line GL18.

The nineteenth gate pulse output through the nineteenth connection line CL19 connected to the nineteenth port P19 is output through the second side of the nineteenth gate line GL19.

Next, the twentieth gate pulse output through the twentieth connection line CL20 connected to the fourteenth port P14 is output through the first side of the twentieth gate line GL20.

Next, the twenty-first gate pulse output through the twenty-first connection line CL21 connected to the twenty-first port P21 is output through the second side of the twenty-first gate line GL21.

Next, the twenty-second gate pulse output through the twenty-second connection line CL22 connected to the twelfth port P12 is output through the first side of the twenty-second gate line GL22.

Next, the twenty-third gate pulse output through the twenty-third connection line CL23 connected to the twenty-third port P23 is output through the second side of the twenty-third gate line GL23.

Next, the twenty-fourth gate pulse output through the twenty-fourth connection line CL24 connected to the tenth port P10 is output through the first side of the twenty-fourth gate line GL24.

Next, the twenty-fifth gate pulse output through the twenty-fifth connection line CL25 connected to the twenty-fifth port P25 is output through the second side of the twenty-fifth gate line GL25.

Next, the twenty-sixth gate pulse output through the twenty-sixth connection line CL26 connected to the eighth port P8 is output through the first side of the twenty-sixth gate line GL26.

Next, the twenty-seventh gate pulse output through the twenty-seventh connection line CL27 connected to the twenty-seventh port P27 is output through the second side of the twenty-seventh gate line GL27.

Next, the twenty-eighth gate pulse output through the twenty-eighth connection line CL28 connected to the sixth port P6 is output through the first side of the twenty-eighth gate line GL28.

Next, the twenty-ninth gate pulse output through the twenty-ninth connection line CL29 connected to the twenty-ninth port P29 is output through the second side of the twenty-ninth gate line GL29.

Next, the thirtieth gate pulse output through the thirtieth connection line CL30 connected to the fourth port P4 is output through the first side of the thirtieth gate line GL30.

Next, the thirty-first gate pulse output through the thirty-first connection line CL31 connected to the thirty-first port P31 is output through the second side of the thirty-first gate line GL31.

Finally, the thirty-second gate pulse output through the thirty-second connection line CL32 connected to the second port P2 is output through the first side of the thirty-second gate line GL32.

According to the present disclosure described as above, the gate pulses GP supplied from the gate driver 200 to the gate lines GL through the connection lines CL are alternately output to the first and second sides of the gate lines GL.

In this case, two gate pulses continuously output to two connection lines provided in the center portion C of the gate lines GL may be output from the first side or output from the second side.

For example, in FIG. 8, the sixteenth gate pulse and the seventeenth gate pulse continuously output through the sixteenth connection line CL16 and the seventeenth connection line CL17 are output from the second side B of the sixteenth gate line GL16 and the seventeenth gate line GL17.

According to the present disclosure described as above, the gate pulses may alternately be output from the left and right sides of the display panel 100. Therefore, a luminance difference between the left and right sides of the display panel 100 is not generated. Therefore, quality of the display apparatus according to the present disclosure may be improved.

According to the present disclosure, the following advantageous effects may be obtained.

According to the present disclosure, the gate pulses may sequentially be output from one side and the other side of the gate lines, whereby a luminance difference does not occur in one side and the other side of the gate lines.

That is, according to the present disclosure, the luminance difference does not occur in one side and the other side of the display panel, whereby quality of the display apparatus may be improved.

It will be apparent to those skilled in the art that the present disclosure described above is not limited by the above-described embodiments and the accompanying drawings and that various substitutions, modifications and variations can be made in the present disclosure without departing from the spirit or scope of the disclosures. Consequently, it is intended that all variations or modifications derived from the meaning, scope and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display apparatus, comprising:

a display panel having a first non-display area outside a display area;

a gate driver provided in the first non-display area;

a data driver provided in the first non-display area;

a controller for controlling the gate driver and the data driver;

connection lines extended from the gate driver, the connection lines being provided in a first direction; and gate lines connected to the connection lines, the gate lines being provided in a second direction different from the first direction, wherein gate pulses supplied from the gate driver to the gate lines through the connection lines are alternately output from a first side and a second side of the gate lines, the first side and the second side of the gate lines are divided from each other based on a center portion of the gate lines as a boundary, the gate driver includes:

an odd shift register including odd flip-flops driven in a second side direction from a first side direction of the gate driver;

an even shift register including even flip-flops driven in the first side direction from the second side direction of the gate driver;

a level shifter unit configured to amplify odd shift clocks and even shift clocks, which are sequentially transmitted from the odd shift register and the even shift register, respectively, and sequentially outputting the amplified odd shift clocks and the amplified even shift clocks; and a buffer unit configured to sequentially output gate pulses amplified by the level shifter unit to the gate lines.

2. The display apparatus of claim 1, wherein first side connection lines of the connection lines, which are connected to the gate driver at the first side, are connected to the first side of the gate lines, and second side connection lines of the connection lines, which are connected to the gate driver at the second side, are connected to the second side of the gate lines.

3. The display apparatus of claim 2, wherein the first side connection lines are alternately connected to odd gate lines and even gate lines of the gate lines, and the second side connection lines are alternately connected to other odd gate lines and other even gate lines of the gate lines.

4. The display apparatus of claim 2, wherein the display panel is provided with first to (g)th connection lines connected to the gate driver and first to (g)th gate lines connected to the first to (g)th connection lines, the first side connection lines of the connection lines are connected to odd gate lines of the first to ((g/2)-1)th gate lines and even gate lines of the (g)th to ((g/2)+2)th gate lines, the second side connection lines of the connection lines are connected to odd gate lines of ((g/2)+1)th to (g)th gate lines and even gate lines of (g/2)th to first gate lines, and wherein 'g' is an even natural number.

5. The display apparatus of claim 4, wherein the first side connection lines are alternately connected to odd gate lines of the first to ((g/2)-1)th gate lines and even gate lines of the (g)th to ((g/2)+2)th gate lines, and the second side connection lines are alternately connected to odd gate lines of the ((g/2)+1)th to (g)th gate lines and even gate lines of the (g/2)th to first gate lines.

6. The display apparatus of claim 1, wherein the odd flip-flops are sequentially driven from the first side direction to the second side direction to sequentially output the odd shift clocks, and the even flip-flops are sequentially driven from the second side direction to the first side direction to sequentially output the even shift clocks.

7. The display apparatus of claim 6, wherein the odd flip-flops and the even flip-flops are alternately driven.

8. The display apparatus of claim 6, wherein odd gate pulses generated by the odd shift clocks are output to odd gate lines of the gate lines, and even gate pulses generated by the even shift clocks are output to even gate lines of the gate lines.

9. The display apparatus of claim 1, wherein the gate driver includes at least two gate driver integrated circuits, (ICs), each of the gate driver ICs including:

the odd shift register;

the even shift register;

the level shifter unit; and the buffer unit, wherein the at least two gate driver Ics include first to (n)th gate driver Ics provided in the second side direction from the first side direction, the first to (n)th gate driver Ics are driven by a start control signal transmitted from a gate driver IC adjacent thereto or the controller, and wherein n is a natural number.

10. The display apparatus of claim 9, wherein an odd shift register provided in an (m)th gate driver IC is driven in accordance with an odd start control signal transmitted from an odd shift register provided in a (m−1)th gate driver IC, an even shift register provided in the (m−1)th gate driver IC is driven in accordance with an even start control signal transmitted from an even shift register provided in the (m)th gate driver IC, and 'm' is less than or equal to 'n'.

11. The display apparatus of claim 1, wherein two gate pulses continuously outputted to two connection lines provided in the center portion of the gate lines are outputted from the first side or outputted from the second side.

12. A display apparatus, comprising:

a display panel having a display area and a non-display area, the non-display area being outside the display area;

a gate driver positioned in the non-display area;

gate lines including:

odd gate lines extending in a second direction; and even gate lines extending in the second direction; and connection lines including:

first side connection lines extending in a first direction different from the second direction, the first side connection lines being positioned on a first side of the gate lines; and second side connection lines extending in the first direction, the second side connection lines being positioned on a second side of the gate lines, the second side and the first side of the gate lines being on opposite sides of a center portion of the gate lines;

wherein gate pulses supplied from the gate driver to the gate lines through the connection lines are alternately output from the first side and the second side of the gate lines;

wherein the gate lines include:

a first gate line;

a fourth gate line;

a second gate line between the first gate line and the fourth gate line, the second gate line being adjacent the first gate line; and a third gate line between the second gate line and the fourth gate line;

wherein the connection lines include:

a first connection line connected to the first gate line;

a second connection line connected to the second gate line, the second connection line being a connection line nearest along the second direction to the first connection line among connection lines connected to the second gate line;

a third connection line connected to the third gate line; and a fourth connection line connected to the fourth gate line;

wherein the first and third connection lines are on the first side, and the second and fourth connection lines are on the second side, wherein the gate driver includes at least one gate driver integrated logic circuit (ILC), and the gate driver ILC includes:

an odd shift register including odd flip-flops driven in a second side direction from a first side direction of the gate driver;

an even shift register including even flip-flops driven in the first side direction from the second side direction of the gate driver;

a level shifter unit for amplifying odd shift clocks and even shift clocks, which are sequentially transmitted from the odd shift register and the even shift register, respectively, and for sequentially outputting the amplified odd shift clocks and the amplified even shift clocks; and a buffer unit for sequentially outputting gate pulses amplified by the level shifter unit to the gate lines.

13. The display apparatus of claim 12, wherein, in operation, a second gate pulse is received by the second gate line between a first gate pulse being received by the first gate line and a third gate pulse being received by the third gate line.

14. The display apparatus of claim 12, wherein the first gate line and the third gate line receive odd gate pulses based on output of odd flip-flops of an odd shift register, and the second gate line and the fourth gate line receive even gate pulses based on an output of even flip-flops of an even shift register.

15. The display apparatus of claim 14, wherein the odd flip-flops are on the first side, and the even flip-flops are on the second side.

16. A display apparatus, comprising:

a display panel provided with at least one non-display areas outside a display area;

a gate driver including gate driver integrated circuit logic (ICL), the gate driver ICL including:

an odd shift register including odd flip-flops driven in a second side direction from a first side direction of the gate driver;

an even shift register including even flip-flops driven in the first side direction from the second side direction of the gate driver;

a level shifter unit for amplifying odd shift clocks and even shift clocks, which are sequentially transmitted from the odd shift register and the even shift register, respectively, and for sequentially outputting the amplified odd shift clocks and the amplified even shift clocks; and a buffer unit for sequentially outputting gate pulses amplified by the level shifter unit to the gate lines;

wherein, in operation, odd shift clocks and even shift clocks are sequentially transmitted from the odd shift register and the even shift register, respectively;

a data driver;

a controller for controlling the gate driver and the data driver, wherein the controller, the gate driver and the data driver are positioned on same side of the display panel;

connection lines extended from the gate driver, the connection lines being provided in a first direction; and gate lines connected to the connection lines, the gate lines being provided in a second direction different from the first direction, wherein gate pulses supplied from the gate driver to the gate lines through the connection lines are alternately output from a first side and a second side of the gate lines, the gate lines including:

a first gate line; and a second gate line adjacent the first gate line;

the first side and the second side of the gate lines are divided from each other based on a center portion of the gate lines as a boundary;

wherein the connection lines include:

a first connection line on the first side and connected to the first gate line; and a second connection line on the second side and connected to the second gate line, the second connection line being a connection line nearest along the second direction to the first connection line among connection lines connected to the second gate line.

17. The display apparatus of claim 16, further comprising:

a film overlapping a first non-display area of the at least one non-display areas;

wherein the gate driver and the data driver area positioned on the film.

18. The display apparatus of claim 16, wherein the controller is positioned in one of the at least one non-display areas, and the gate driver and the data driver are positioned in a same non-display area of the at least one non-display areas.

19. The display apparatus of claim 16, wherein the gate driver includes first to (n)th gate driver logic circuits provided in the second side direction from the first side direction, the first to (n)th gate driver logic circuits being driven by a start control signal transmitted from a respective gate driver IC adjacent thereto or the controller, wherein n is a natural number.

* * * * *